US006753659B2

(12) United States Patent
Busse et al.

(10) Patent No.: US 6,753,659 B2
(45) Date of Patent: Jun. 22, 2004

(54) OPERATING DEVICE FOR DISCHARGE LAMPS HAVING A PREHEATING DEVICE

(75) Inventors: Olaf Busse, München (DE); Bernhard Schemmel, Wessling (DE); Michael Weirich, Unterhaching (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/323,747

(22) Filed: Dec. 20, 2002

(65) Prior Publication Data

US 2003/0122499 A1 Jul. 3, 2003

(30) Foreign Application Priority Data

Jan. 2, 2002 (DE) ..... 102 00 053

(51) Int. Cl.[7] ..... H05B 37/02

(52) U.S. Cl. ..... 315/209 R; 315/248; 315/276; 315/283; 315/DIG. 2; 315/DIG. 5; 315/DIG. 7

(58) Field of Search ..... 315/209 R, 233, 315/239, 241 R, 242, 244, 246, 248, 267, 276, 283, 344, 338, DIG. 2, DIG. 5, DIG. 7

(56) References Cited

U.S. PATENT DOCUMENTS 5,363,020 A * 11/1994 Chen et al. ..... 315/209 R
5,757,140 A 5/1998 Nilssen ..... 315/209 R
6,140,771 A * 10/2000 Luger et al. ..... 315/101
6,307,329 B1 * 10/2001 Beij et al. ..... 315/224
6,366,031 B2 * 4/2002 Klien ..... 315/291
6,433,490 B2 * 8/2002 Koch et al. ..... 315/224

FOREIGN PATENT DOCUMENTS

| | | |
|---|---|---|
| DE | 101 02 837 | 7/2002 |
| EP | 0271396 | 6/1988 |
| GB | 2110890 | 6/1983 |
| JP | 09260080 | 3/1997 |
| JP | 11185984 | 9/1999 |

* cited by examiner

*Primary Examiner*—James Clinger
*Assistant Examiner*—Thuy Vinh Tran

(57) ABSTRACT

An operating circuit for a discharge lamp (LP) having preheatable electrodes includes a device (C14, T11, T12, T13, G) for preheating the electrodes. The device includes a resonant circuit (C14, T11) which oscillates during preheating. During operation, the operating circuit produces an AC voltage having a frequency that is moved through a frequency range, records the response of the resonant circuit (C14, T11) by measuring an electrical variable (UC14), and identifies the resonant frequency of the resonant circuit (C14, T11) from the electrical variable (UC14), and preheats the electrodes by setting the frequency of the AC voltage to the resonant frequency.

5 Claims, 2 Drawing Sheets

OPERATING DEVICE FOR DISCHARGE LAMPS HAVING A PREHEATING DEVICE

TECHNICAL FIELD

The invention relates to an operating circuit for a discharge lamp having electrodes which can be preheated.

BACKGROUND ART

It is known for the resonance of a resonant circuit to be used for the preheating mode of the operating circuit in discharge lamps in which electrodes are intended to be preheated. For example, the electrodes to be preheated may on the one hand be connected to a frequency generator in the operating circuit and may on the other hand be connected via a capacitor and optional further components to a preheating device. The preheating device thus contains a resonant circuit whose oscillations cause current to flow through the electrodes. When the operating device produces an oscillation in the resonant circuit, the electrodes are in consequence preheated. The preheating mode may be ended, for example, by the heating of a PTC thermistor.

In a prior German Patent Application with the file reference 101 02 837.7 ("Operating device for discharge lamps with the filament heating being switched off"), the applicant has already proposed an operating device in which a preheating transformer is used for the preheating process, which is carried out at a resonant frequency of a resonant circuit, to which the primary winding of the transformer is connected.

DISCLOSURE OF THE INVENTION

The present invention is based on the technical problem of specifying an operating circuit for discharge lamps having electrodes which can be preheated, which operating circuit has an improved preheating device.

The invention provides that the operating circuit is designed to produce an AC voltage at the start of operation, in the process to move through a frequency range which includes the resonant frequency of the resonant circuit and, in the process, to record the response of the resonant circuit by measuring an electrical variable such that the resonant frequency can be identified and the lamp can be preheated at this resonant frequency.

Advantageous embodiments are described in the dependent claims.

The invention is based on the fundamental idea, which has already been included in the cited unpublished patent application, of using a resonant circuit and its resonance for preheating. The invention is also based on an operating circuit, in which the operating frequency of the operating circuit can be varied and adjusted. The invention proposes that, at the start of operation, a search is made through a frequency range for the resonant frequency of the resonant circuit, which frequency range is chosen such that it can be reliably assumed that the resonant frequency can be found in this frequency range. The resonant frequency may, for example, be identified by determining the amplitude of a voltage value or of a current value. In this case, there is also no need to move through the entire frequency range and, in fact, the process of moving through this frequency range can be stopped once the resonant frequency has been found. For example, it would be possible to use rising voltage or current values and a decrease in these values once again to deduce that the process has passed through the maximum, and to define this maximum as the resonance peak.

The resonant frequency of the resonant circuit can thus be identified, and can be used for the subsequent preheating process. This makes it possible to ensure particularly efficient preheating, on the other hand excluding influences resulting from component tolerances or temperature fluctuations which, for example, may vary inductances.

A further advantageous option is to use the level of the detected amplitude at the resonance peak to deduce the type of discharge lamp being used. This is because, if the operating circuit is designed such that not only the operating frequency but also other operating parameters are adjustable, it can then be used for different lamp types. This procedure is particularly convenient if the operating circuit adjusts itself automatically to the lamp type being used. The lamp type can, of course, be detected by additional coding of the lamp. However, it is simpler and/or more convenient to use the technical characteristics of the lamp, which exist in any case, for identification. In particular, the resistances of the lamp electrodes in different lamp types differ. This results in different attenuations of the resonance, which can be detected and can be used to deduce the lamp type. The operating circuit can then set the appropriate operating parameters.

Identification of the lamp type may, in principle, be worthwhile even if only one lamp type is in principle envisaged. It is then possible to prevent a lamp type which fits mechanically but is electrically unsuitable for being inserted and operated. In this situation, the operating circuit could refuse to switch on if an incorrect lamp type were identified.

The use of a preheating transformer in the preheating device as has already been described in the cited unpublished prior application is preferred. The disclosure content relating to this, in particular with regard to the various connection options and embodiment variants for the resonant circuit, is hereby expressly referred to. In any case, two secondary winding of the preheating transformer should in each case be connected to one of the electrodes of the discharge lamp, in order to allow the discharge lamp to be preheated. Furthermore, the preheating transformer must be connected to the resonant circuit, with the resonant circuit preferably being located on the primary side, that is to say with the primary winding being connected to the resonant circuit. This allows the appropriate oscillations in the resonant circuit to be initiated by a frequency generator in the operating circuit without having to be transformed to the voltage level on the secondary side.

One advantageous option for detecting the response of the resonant circuit in order to identify the resonant frequency and, if necessary, also to determine the strength of the resonance for lamp type identification purposes is to measure the maximum amplitude of the voltage on the primary winding of the preheating transformer. To do this, this voltage is preferably rectified, as illustrated in the exemplary embodiment.

The frequency generator for the operating circuit is preferably in the form of a digital controller, which produces frequencies digitally. In this case, the frequency range can be moved through, according to the invention, in steps. To this extent, the appropriate frequency step which is closest to the resonant frequency is detected, rather than the actual resonant frequency itself. In principle, it is irrelevant to the technical function of the invention whether the resonant frequency is detected precisely. The aim is to use only the resonant peak for preheating purposes. Owing to the attenuation of the resonance as a result of the resistances of the electrodes, the resonance is in general not very narrow in any case, so that the aim is only to approach the resonant frequency approximately.

An advantageous order of magnitude for the resonant frequency is twice the operating frequency of the operating circuit in continuous operation of the discharge lamp. Typical orders of magnitude may, for example, be about 80–100 kHz for the resonant frequency and approximately 40–50 kHz for the continuous operating frequency.

BRIEF DESCRIPTION OF THE DRAWINGS

An exemplary embodiment of the invention will be explained in the following text, in order to illustrate the invention in more detail. Individual features disclosed in the process may also be significant to the invention in other combinations. In addition, it should be noted that the invention may have a method character and that the disclosure content above and in the following text can also be applied to method features.

BEST MODE FOR CARRYING OUT THE INVENTION

Figure 1:
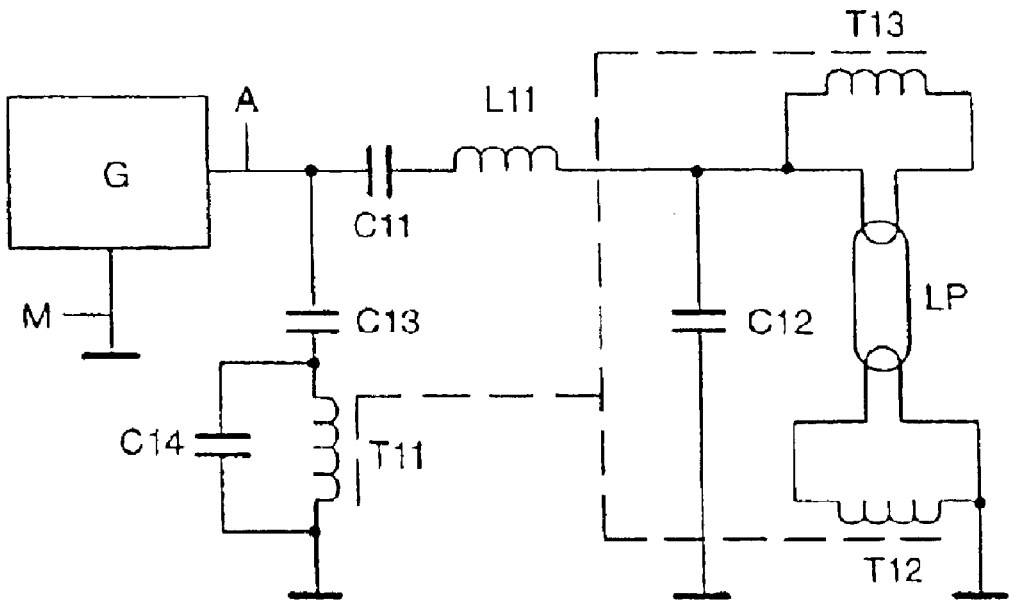
FIG. 1 shows a schematic circuit diagram of an operating circuit according to the invention.

FIG. 1 shows an electronic ballast as the operating circuit according to the invention. LP denotes a low-pressure discharge lamp, whose filament electrodes, which can be preheated, are shown. G denotes an AC voltage generator, which is a digital controller with digital frequency definition and devices for the procedure explained in FIG. 2 and in the associated description. A high-frequency AC voltage with respect to a reference ground potential M is produced at an output A. This may be, for example, a half-bridge oscillator with two switching transistors driven by a digital controller.

The lamp LP is connected in an intrinsically conventional manner between the output A and ground, with a series circuit comprising a coupling capacitor C11 for blocking DC components and a lamp inductor L11 being connected between the electrode (at the top in FIG. 1) on the supply voltage side and the output A. The lamp inductor is used for matching the discharge lamp to the generator G. A starting capacitor C12, which is connected between the electrode on the supply voltage side, the discharge lamp LP and ground, is used to produce a starting voltage, and may likewise also be used for matching. The starting capacitor is connected in parallel with the discharge lamp LP, to be precise to in each case one connection of each electrode.

Furthermore, a so-called trapezoidal capacitor C13 is provided between the output A and ground and is used to reduce the switching load on said switching transistors. To the extent described so far, the operating circuit illustrated in FIG. 1 is conventional and will be familiar to those skilled in the art from other publications, so that the details need not be explained any further here.

A parallel resonant capacitor C14, with a primary winding T11 of a preheating transformer connected in parallel with it, is connected between ground and that side of the trapezoidal capacitor C13 to which the supply voltage is not connected. The parallel resonant capacitor C14 and the primary winding T11 form a resonant circuit with a resonant frequency which is governed by these variables. The primary inductance which acts on the primary winding T11 must be taken into account when calculating the resonant frequency. The heating transformer may have a so-called loose coupling, in order to achieve sufficiently high values for the primary inductance. The resonant frequency is designed such that it corresponds approximately to twice the continuous operating frequency. The choice of twice the continuous operating frequency has the advantage that the continuous operating frequency cannot stimulate oscillation of the resonant circuit. Since virtually square-wave voltages are used and these essentially have odd-numbered harmonics, it is advantageous to choose the frequency to be in the vicinity of twice the operating frequency. A range between +/−20% of twice the operating frequency is preferable.

The preheating transformer has two secondary windings T12 and T13, with said loose coupling between the secondary windings and the primary winding T11 being illustrated by the dashed lines in FIG. 1. The secondary windings T12 and T13 are each connected to the electrodes of the discharge lamp LP, so that currents induced in the secondary windings flow through the electrodes. The resonant circuit comprising the parallel resonant capacitor C14 and the primary winding T11 thus interact jointly with the secondary windings T12 and T13 as a preheating device.

Since the resonant frequency is twice the continuous operating frequency, the resonant circuit also has a low impedance, in comparison to the trapezoidal capacitor C13, during continuous operation and therefore does not interfere with the functions of the operating circuit in continuous operation. Only very small voltages are thus applied to the primary winding T11 during continuous operation, so that any additional heating currents resulting from them in the filament electrodes are negligible.

However, in the preheating mode, the frequency generator G is intended to stimulate the resonant circuit at a frequency in the immediate vicinity of its resonant frequency, so that high currents flow through the primary winding T11, and corresponding preheating currents are induced in the secondary windings T12 and T13.

With regard to the method of operation and the circuit design of the operating circuit shown in FIG. 1, reference is also made, in supplementary form, to the already cited unpublished prior application.

The invention now provides for the digital control for the frequency generator G to move through a specific frequency range around the resonant frequency of the resonant circuit C14, T11 at the start of operation, in order, so to speak, to search for the resonant frequency. This is illustrated in the form of an example in FIG. 2. The resonant frequency is assumed to be in the vicinity of 90 kHz. Initially, the frequency of the half-bridge oscillator in the frequency generator is set to 95 kHz by the digital controller.

Figure 2:
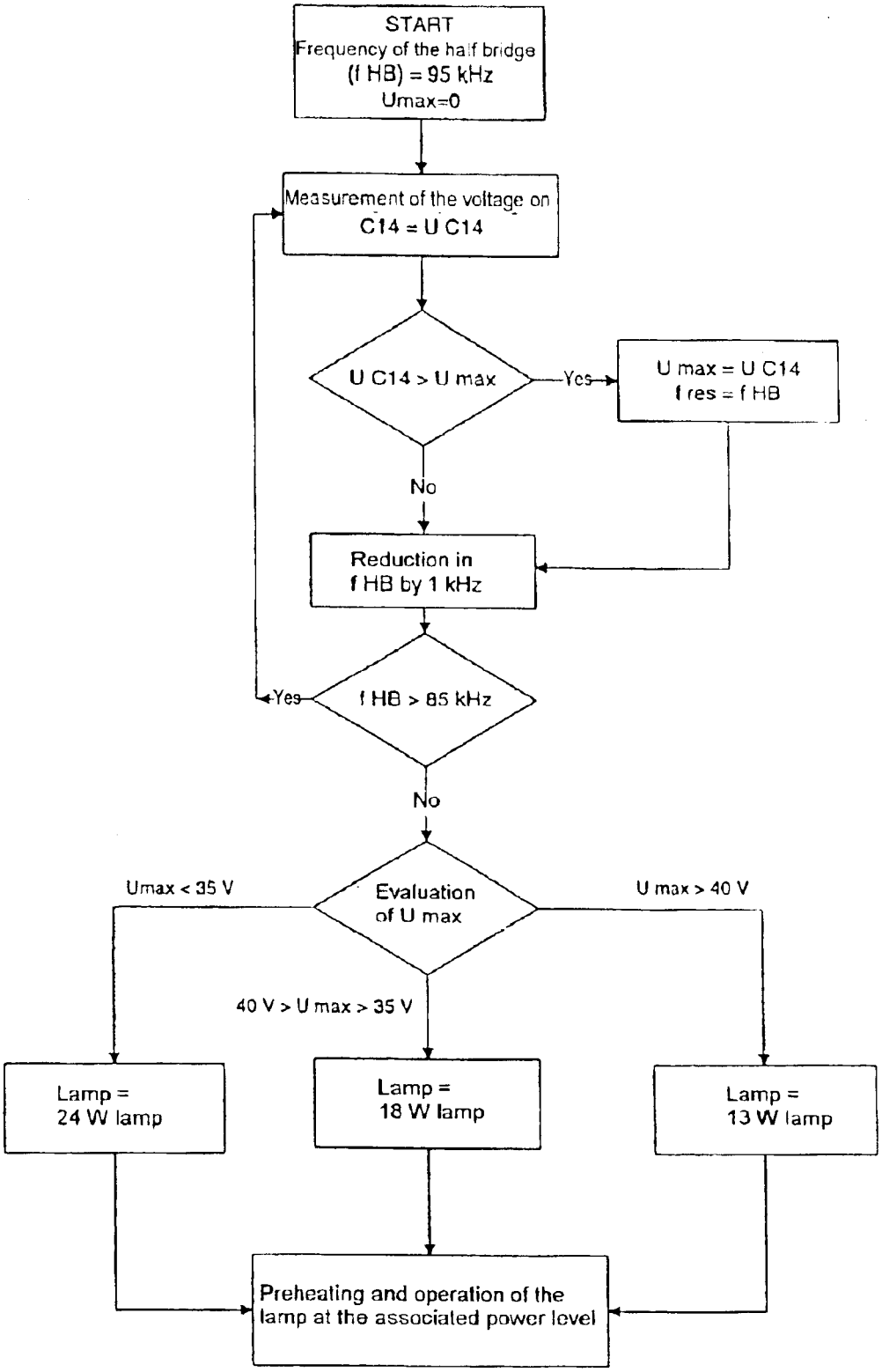
FIG. 2 shows an example of the procedure relating to the method of operation of the operating circuit.

The digital controller measures the voltage on the primary winding T11 and/or on. the parallel resonant capacitor C14 (UC14) and, during the procedure illustrated in FIG. 2, searches for the maximum value of this voltage, in order to identify the resonant frequency. This maximum value is abbreviated to Umax in FIG. 2, is stored in a memory in the digital controller, and is initially set to 0.

After brief operation using a half-bridge frequency of 95 kHz, the voltage UC14 is measured and an assessment is carried out to determine whether this is greater than Umax. Since Umax is still set to 0, the answer to this question is yes. The measured value for UC14 can now be stored as the new value of Umax, as indicated by the arrow pointing to the right. The predetermined half-bridge frequency (fHB) of 95 kHz is stored in a corresponding manner as the resonant frequency fres, in a further memory.

The half-bridge frequency is then, for example, reduced by 1 kHz, so that it is now 94 kHz. The answer to the subsequent question as to whether the half-bridge frequency is greater than 85 kHz is in consequence yes, so that the process moves back to the measurement of the voltage UC14.

As can be seen, this loop is passed through until the half-bridge frequency arrives at 85 kHz. Since the memory which stores Umax was overwritten only when the new measured value was greater than the previous measured value, the Umax memory contains the highest measured value. A corresponding procedure applies to the associated resonant frequency, which is actually the half-bridge frequency at which this Umax value was measured.

After passing through 85 kHz, the answer to the question in the center of FIG. 2 is no, so that Umax can now be evaluated. In the present example, a distinction is drawn between maximum voltage values below 35 V, between 35 V and 40 V and above 40 V, which are respectively associated with a 24 W lamp, an 18 W lamp and a 13 W lamp. This association is possible since the lower-power lamps have filament electrodes composed of thinner wires and they therefore cause the least attenuation at resonance since their resistances are higher. In consequence, the highest primary winding voltages UC14 occur with the low-wattage lamps.

The digital controller can now carry out a preheating mode using the determined correct resonant frequency of the resonant circuit C14, T11, with the resonant frequency being applicable irrespective of fluctuations resulting from temperature changes or component fluctuations between different individual operating circuits. In addition, digital control can set, for example, the parameters which are suitable for the appropriate lamp type for the preheating mode, that is to say approximately for the preheating time, as well as for the subsequent continuous operation.

Figure 3:
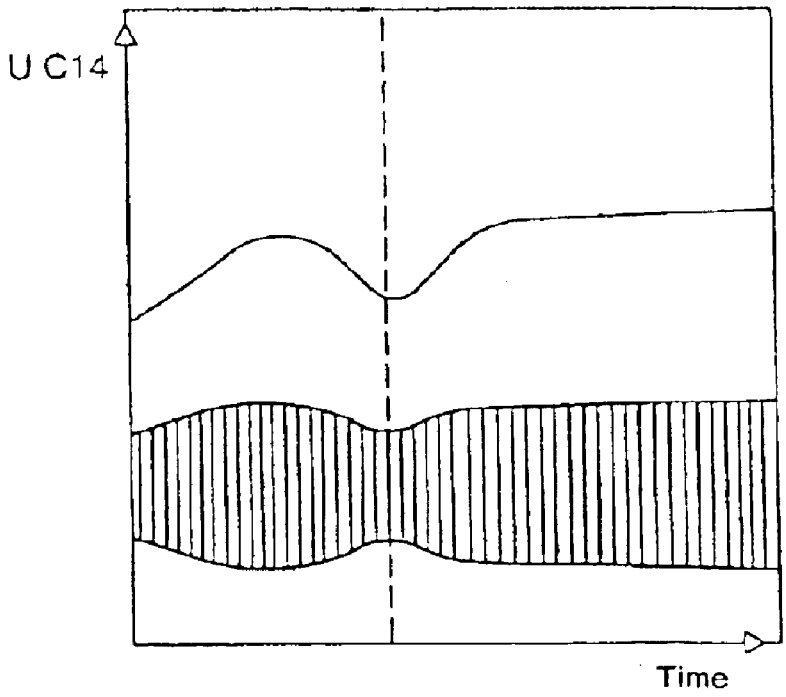
FIG. 3 shows two measurement curves in order to illustrate the procedure shown in FIG. 2.

FIG. 3 shows an example of the profile of an illustration of the primary winding voltage UC14 on an oscilloscope. The actual voltage UC14 is plotted in the lower area, which oscillates at the varying frequency, while the upper area shows the rectified and smoothed voltage on which the measurement by digital controller is actually based. This frequency changing process from 95 kHz to 85 kHz, as explained with reference to FIG. 2, takes place from the left-hand edge of the figure as far as the dashed vertical line. As can be seen, the voltage UC14 has passed through a maximum during this period. After the end of the process, the digital controller moves back to the appropriate frequency value, so that the preheating mode can be carried out at the resonant frequency, to the right of the dashed vertical line.

What is claimed is:

1. An operating circuit for a discharge lamp (LP) having preheatable electrodes, the operating circuit comprising a device (C14, T11, T12, T13, G) for preheating the electrodes, the device having a resonant circuit (C14, T11) which osculates during preheating, wherein:

the operating circuit is operable to:

(i) produce an AC voltage having a frequency;

(ii) move the frequency of the AC voltage through a frequency range which includes a resonant frequency of the resonant circuit (C14, T11);

(iii) record a response of the resonant circuit (C14, T11) by measuring an electrical variable (UC14);

(iv) identify the resonant frequency from the electrical variable (UC14); and (V) preheat the electrodes by setting the frequency of the AC voltage to the resonant frequency; and a resonance amplitude (Umax) of the resonant circuit (C14, T11) is determined in order to make it possible to identify a type of discharge lamp (LP) being used.

2. The operating circuit as claimed in claim 1, wherein the operating circuit is designed for operating a number of lamp types and is furthermore designed to carry out the operation using operating parameters associated with the identified lamp type.

3. A operating circuit for a discharge lamp (LP) having preheatable electrodes, the operating circuit comprising a device (C14, T11, T12, T13, G) for preheating the electrodes, the device a resonant circuit (C14, T11) which oscillates during preheating, wherein:

the operating circuit is operable to:

(i) produce an AC voltage having frequency;

(ii) move the frequency of the AC voltage through a frequency range which includes a resonant frequency of the resonant circuit (C14, T11);

(iii) record a response of the resonant circuit (C14, T11) by measuring an electrical variable (UC14);

(iv) identify the resonant frequency from the electrical varible (UC14); and (v) preheat the electrodes by setting the frequency of the AC voltage to the resonant frequency;

the preheating device (C14, T11, T12, T13, G) contains a preheating transformer (T11, T12, T13) having a primary winding (T11) and two secondary windings (T12, T13), wherein each of the two secondary winding (T12, T13) is connected to one electrode of the discharge lamp (LP); and the response of the resonant circuit (C14, T11) above a maximum amplitude (Umax) of the electrical variable (UC14) is recorded on the primary winding (T11) of the preheating transformer (T11, T12, T13).

4. An operating-circuit for a discharge lamp (LP) having preheatable electrodes, the operating circuit comprising a device (C14, T11, T12, T13, G) for preheating the electrodes, the device having a resonant circuit(C14, T11) which oscillates during preheating, wherein;

the operating circuit is operable to:

(i) produce an AC voltage having a frequency;

(ii) move the frequency of the AC voltage through a frequency range which includes a resonant frequency of the resonant circuit (C14, T11);

(iii) record a response of the resonant circuit (C14, T11) by measuring an electrical variable (UC14);

(iv) identify the resonant frequency from the electrical variable (UC14); and (v) preheat the electrodes by setting the frequency of the AC voltage to the resonant frequency; and the operating circuit further comprises a digital controller $(G)_2$ and the frequency of the AC voltage is moved through the frequency range in steps.

5. The operating circuit as claimed in claim 4, wherein the resonant frequency is approximately twice a continuous operating frequency.

* * * * *